United States Patent [19]

Kusznir

[11] Patent Number: 4,721,021

[45] Date of Patent: Jan. 26, 1988

[54] HANDLE STRUCTURE

[76] Inventor: Phillip S. Kusznir, 750 E. Carson #10, Carson, Calif. 90745

[21] Appl. No.: 905,550

[22] Filed: Sep. 10, 1986

[51] Int. Cl.[4] ..... B25C 1/00

[52] U.S. Cl. ..... 81/22; 81/489

[58] Field of Search ..... 81/489, 492, 20, 22; 30/340; 16/110 R, 116 R, DIG. 18; 7/145, 167

[56] References Cited

U.S. PATENT DOCUMENTS

| | | | |
|---|---|---|---|
| 4,331,193 | 5/1982 | Tudisco | 81/22 |
| 4,633,741 | 1/1987 | Yang | 81/20 |

FOREIGN PATENT DOCUMENTS

| | | | |
|---|---|---|---|
| 628656 | 10/1961 | Canada | 81/22 |
| 8200265 | 2/1982 | PCT Int'l Appl. | 81/22 |

*Primary Examiner*—Frederick R. Schmidt
*Assistant Examiner*—Judy J. Hartman
*Attorney, Agent, or Firm*—George A. Maxwell

[57] ABSTRACT

An improved handle structure for manually engagable, manually manipulated implements and devices such as hammers, saws, hand power tools and the like. The handle structure is an elongate structure adapted to be comfortably gripped in a hand of a user. The handle is resilient and yieldingly compressable within the grip of a user on a plane which is normally substantially parallel to the mean plane of the palm of a user's hand and which provides a non-static, shock absorbing grip structure. The handle structure is substantially rigid and non-yielding on that plane which is normal to said plane of the user's hand. The handle further includes a soft resilient fingertip supporting pad that conforms with and yieldingly supports the user's fingers and soft resilient palm engaging parts that yieldingly conform with the palm of the user's hand at primary force transmitting points between the palm and the handle structure and which provides for circulation of air therebetween. The handle structure provides for a non-static yet stable and secure grip between the user's hand and the implement or device with which the handle structure is related.

5 Claims, 6 Drawing Figures

DOTTED LINES INDICATE COMPRESSED POSITION OF WEBS

HANDLE STRUCTURE

BACKGROUND OF THE INVENTION

In a large percentage of human activities, manually engagable implements and devices are commonly and regularly used. The great majority of those implements and devices include and are characterized by hand engagable grips or handles about which the user's hands are securely engaged to establish physical control of their the related implements and devices, when put to their intended use.

The prior art handles for the majority of implements and devices are parts related to or are portions of those implements and devices which are basically straight elongate parts or portions of sufficient length to extend laterally and/or diagonally across the palms of the hands of the users and which are of sufficient cross sectional size and shape that, when placed in contact with and across the palms of the user's hands, the users can conveniently establish tight and secure gripping engagement about them by turning or bending their fingers and thumbs about the handles and urging the handles into secure engagement within the palms of their hands and between their fingers and thumbs.

Throughout the years, it has been common practice to form and/or shape handles in various special ways to enhance the security of the grip a user can attain therwith and/or to make the handles as comfortable to grip as is practical and/or possible. Further, it is also common practice to provide such handles with soft yielding covers or jackets of leather, rubber and the like, to absorb shock forces and/or to allow for limited confirmation of the outer surface portions of the handles with the user's hands. Still further, it is common practice to provide such handles with perforated coverings, jackets, and the like, which serve to afford some circulation of air and other fluids between the handles and the user's hands and to thereby enhance the comfort and serviceability of the handles.

No two persons hands are alike with respect to size, shape, strength, flexibility, endurance, toughness and the like. Further, the grip engaging hands of substantially all individuals undergo major physical changes at rapid rates, as their hands are used and as environmental conditions change. One notable fast occuring change that takes place in the grip engaging hand of a person is the thickness or "bulk" of the hand. As a general rule, one's gripping hand commences to fill with body fluids and to swell or "pump up" as soon as continuous work is commenced and, oftentimes, swells to a greater extent and becomes stiff as work continues and fatigue sets in. As a result of the foregoing, when the design and construction of handles is given due consideration, the size, shape and construction of handles provided by the prior art is, as a general rule, a mere compromise as regards the size, shape and construction thereof and is intended to be as serviceable as possible for as many potential individual users thereof as is possible.

With the foregoing well known in the art, prior efforts have been made to construct handles which are sufficiently soft, plastic and/or resilient to conform to the size and shape of a user's hand, when initially gripped and as the user's grip thereabout is sustained. Unfortunately, such efforts have failed to bring about satisfactory results since the imposition of such soft, plastic and/or resilient handle structures between the hands of the users and the implements or devices of which the handles are a part interfere with and so reduce the feel and necessary secure control of implements or devices that they constitute an impairment to the effective use of the implements and devices.

To the best of my knowledge and belief, the most satisfactory soft and resilient type of handle structure thus far provided by the prior art are those synthetic rubber grips which are engaged about the handles of some makes of hammers and on the handlebars of bicycles and the like. Such soft and resilient rubber or rubber-like grips often afford notable shock absorbing and protective characteristics but, as a general rule, must be made and are sufficiently hard and stiff so that they cannot and do not conform to a user's hand in a manner to establish a comfortable and effective fit therebetween. Further, they are generally sufficiently stiff and hard so that the user's grip thereon is maintained substantially static.

It has been long recognized and well understood by many who are skilled in the art of hand tools and the like, that the inherent inadequacies found in handles or hand grips provided by the prior art are a principal cause of premature fatigue of the hands and arms of persons using implements and devices with which ordinary manually engagable handles are related and that such fatigue results in a notable and costly reduction of work output and the production of inaccurate or inferior work.

OBJECTS AND FEATURES OF MY INVENTION

It is an object of my invention to provide an improved handle structure which is such that it readily conforms to the hand of a user in which it is gripped while maintaining firm, direct controlled engagement with the user's hand whereby direct and positive feel and control of the implement or device with which the handle is related is not lost or compromised, but rather, is enhanced.

It is another object and feature of my invention to provide an improved handle structure of the general character referred to above which is substantially rigid and non-flexible on that plane which is substantially normal to the mean plane of the user's hand and which extends between the central portion of the palm of the user's hand and the outer end portion of the user's thumb and fingers engaged about it, but which is sufficiently soft and yielding to readily yield and conform with the palm, thumb and fingers of the user's hand at substantially all primary force transmitting bearing points therebetween.

Yet another object and feature of my invention is to provide an improved handle structure of the general character referred to above which is resilient and yieldingly compressible between the heel portion of the palm of a user's hand (which occurs adjacent the user's wrist and base of the user's thumb) and the inner end portion of the fingers (where they join the palm) of a user's hand gripped about it and which, therefore, resiliently yields to and dampens forces directed by the handle onto the said heel portion of the palm and inner end portions of the fingers of the user's hand to dampen and reduce shock forces directed by the handle on to the user's hand; thereby reducing the rate of fatigue and resulting interference with proper use and functioning of a related implement or device.

Yet another object and feature of my invention is to provide an improved handle structure of the general character referred to above which is resiliently flexible on that central longitudinal plane which is substantially parallel with the longitudinal axis of the user's forearm and which is substantially parallel to the mean plane on which the palm and outer end portions of the fingers and thumb of the user's hand occur when the handle is gripped and its related implement or device is put to its intended use; and, which is rigid and non-flexible yet soft and conformable laterally of said central longitudinal plane, inward of the outer end portions of the palm and the thumb and fingers of the user's hand.

An object and feature of my invention is to provide a handle structure of the general character referred to above having upper and lower end portions which occur above the inner or thumb side and the lower or outer small finger side of a user's hand and which has a plurality of spaced, thin, substantially flat and parallel webs on a plane normal to said central longitudinal plane, defined above, and which extend longitudinally between said upper and lower end portions: the major cross sectional dimension or depth and resulting stiffness, of the webs being sufficient and such as to make the handle rigid and non-yielding laterally of said central longitudinal plane and yieldingly resiliently flexible parallel to that plane.

Further, it is an object and feature of my invention to provide a handle structure of the general character referred to above wherein said webs define longitudinally extending slot-like through openings opening adjacent the palm and outer end portions of the user's thumb and fingers.

Another object and feature of my invention is to provide a handle structure of the general character referred to above including a finger supporting pad receiving recess at the side of the handle opposing the outer end portions of the user's thumb and fingers and at which the slot-like through openings open; a soft, resilient finger pad of resilient formable material in said recess and longitudinally extending ribs of said resilient formable material on said pad in retained engagement in said slot-like through openings and projecting from said openings at the other or opposite side of the handle and defining laterally outwardly projecting longitudinally extending resilient, formable, palm engaging, cleat-like beads on said other or opposite side of the handle.

The foregoing and other objects and features of my invention will be apparent and will be fully understood from the following detailed description of typical preferred embodiments of my invention throughout which description reference is made to the accompanying drawing.

DETAILED DESCRIPTION OF THE INVENTION

Figures 1, 2, 3, 4, 5, 6:
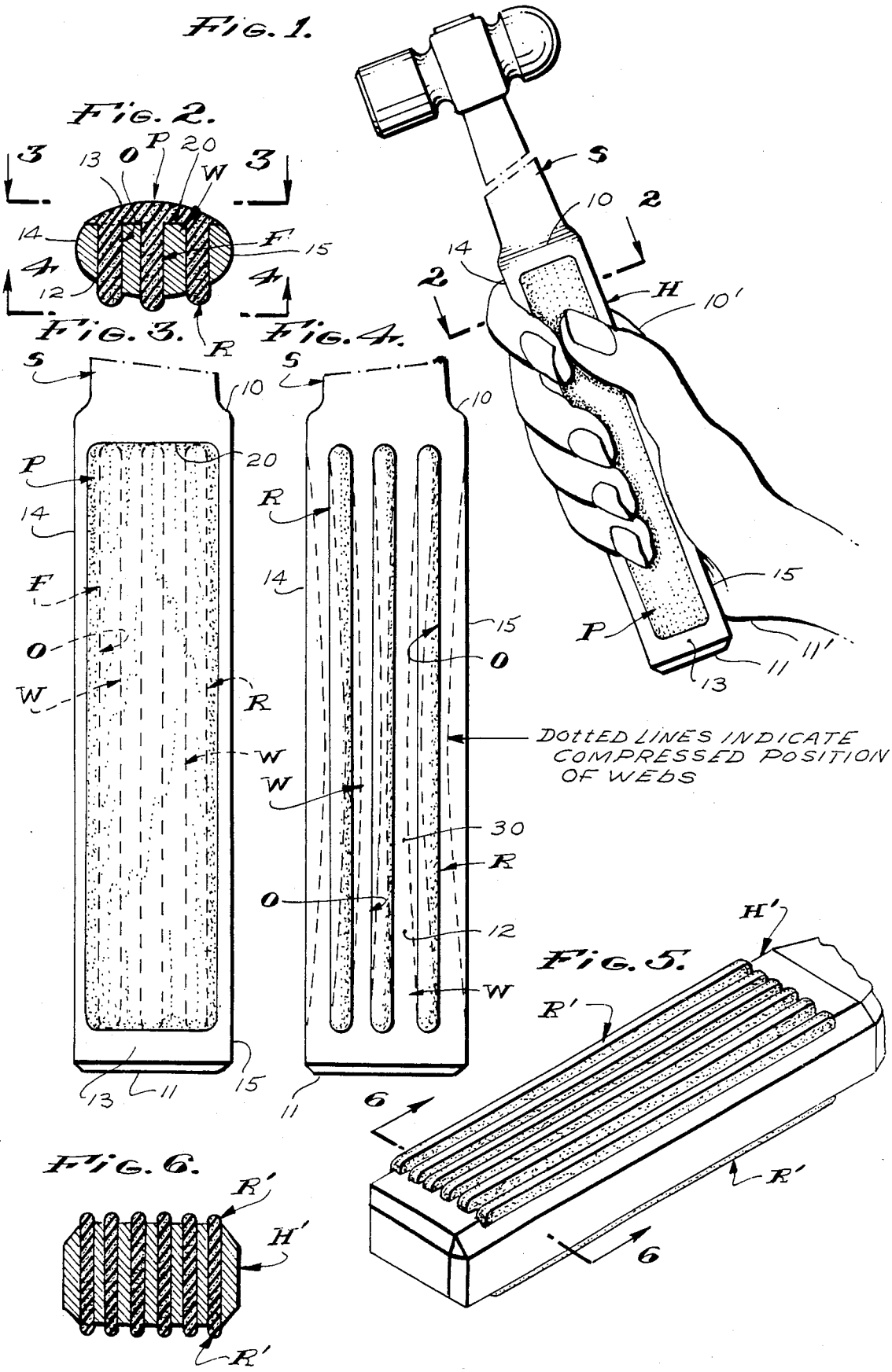
FIG. 1 is an elevational side view of a hammer with a handle embodying my invention and engaged in a user's hand.
FIG. 2 is an enlarged, detailed, cross-sectional view taken on Line 2—2 on FIG. 1.
FIG. 3 is a view taken on Line 3—3 on FIG. 2.
FIG. 4 is a view taken on Line 4—4 on FIG. 2.
FIG. 5 is an isometric view of another embodyment of my invention.
FIG. 6 is a view taken on Line 6—6 on FIG. 5.

In FIG. 1 of the drawings 1 have shown a hammer with an elongate handle structure H embodying my invention. The handle is shown gripped in a user's hand. The handle H has an elongate shank S that is integrally joined to it and which extends to and is suitably connected with the head of the hammer. The elongate handle will be described as being vertically disposed and as having a central vertical longitudinal axis. The handle H has what will hereinafter be called upper and lower ends, 10 and 11, which, when in use, occur adjacent the upper and lower sides 10' and 11' of the user's hand; a laterally inwardly disposed inner side 12 which opposes the palm of the user's hand; an opposite laterally outwardly disposed outer side 13 that opposes the outer end portion of the user's fingers and thumb; a forwardly disposed front edge portion or side 14 that opposes the inner end portions of the user's fingers and the adjacent portion of the user's palm; and, an opposite rearwardly disposed rear side or edge portion 15 that opposes the heel portion of the user's hand adjacent the juncture of the palm and thumb. Since, in practice, the axis of the handle, when gripped in the hand of a user, extends diagonally of the user's palm and the user's thumb and fingers extend about at least two sides and/or edge portions of the handle, the above definition of the several sides and edge portions of the handle might be taken exception to. Accordingly, it is to be understood that the foregoing defining of the sides and edge portions of the handle is merely intended to establish a basis for the proper orientation and arrangement of the various parts and portions of the handle structure in the following description thereof.

Further, for the purpose of describing my invention, the handle will be described as having a flat central vertical plane intersecting the central longitudinal axis thereof and extending forwardly and rearwardly through the front and rear edge portions 14 and 15 thereof. Said plane has opposite laterally disposed inner and outer sides.

In practice, the handle structure H can be made of any suitable strong, durable and suitably elastic and flexible material. I have made satisfactory prototype handles of wood, resin reinforced fiber materials and metals. Wood and resin reinforced fiberglass have proven to be most satisfactory though the use of suitable metals and molded plastics can doubtless be satisfactorily used.

The handle structure H illustrated is, in accordance with common practice, substantially straight intermediate its end portions 10 and 11 and is ovoid in cross-section whereby the several sides and edge portions thereof fair smoothly, one into another, in such a manner that clear lines of definition between adjacent sides and edge portions are ill defined. In the case of handles for tennis rackets and the like, as shown in FIG. 5 of the drawings, which are customarily substantially rectilinear in cross section, the several sides and edge portions are more clearly definable.

The handle structure H includes a plurality of elongate, preferrably parallel, longitudinally extending and laterally inwardly and outwardly opening slot-like through openings O. That is, the openings O are on planes normal to said central plane of the handle and open at the inner and outer sides 12 and 13 thereof.

The through openings or slats O in and through the handle define a plurality of thin, flat, longitudinally extending webs W. The webs W are rectangular in cross section and are positioned within the handle with their major cross sectional axes normal to said central plane of the handle and extending laterally between said inner and outer sides 12 and 13 of the handle. The minor cross sectional axes of the webs, which are normal to the major cross sectional axes thereof, extend fore and aft in the handle and relative to the front and rear edges and parallel to said central plane. The amount or depth of material of the webs W through their major cross sectional axes is such that the webs are sufficiently strong and stiff so that, collectively, they render the handle laterally inflexible or rigid in normal manipulation and use of the handle structure. The amount or width of material of the webs W, through their minor cross sectional axes, is such that the webs are sufficiently weak, fore and aft, in a direction parallel to said central plane of the handle so that they are readily flexed and yieldingly moved or displaced in advance of compressive forces directed onto the front and rear edges of the handle structure by and between the palm and fingers of a user's hand.

Thus, the handle is resiliently flexible and yieldingly compressible fore and aft and is substantially rigid and non-flexible laterally, which unique characteristics are sought to be attained and are highly desirable.

At this point, it is to be noted that fore and aft resilient flexing of the handle, such as here provided, is, with rare exception, most desirable since such flexing serves to absorb the primary shock forces encountered without loss or impairment of control of the hammer (or other implement or device). On the other hand, lateral resilient flexing of a handle, with rare exception, is highly undesirable as it tends to interfere with and impair control of the implement or device with which the handle is related. Lateral flexing of a handle must be compensated for by manually applied lateral countering forces to maintain control of a related implement or device. The exerting of such lateral countering forces are not merely non-productive but are highly fatiguing and, when required to be exerted, are a most common cause for premature fatigue and the loss of accuracy, productivity and the like.

Fore and aft resilient compressibility of a handle, such as here provided, is of great importance and benefit since it allows for substantial conforming of the handle to the hand of the user where primary gripping forces are applied thereto. Thus, the fore and aft resiliency and compressibilitly of my new handle structure, in addition to absorbing shock forces, affords a more comfortable grip.

Of equal or greater importance, the above noted flexibility and compressibility of my new handle structure affords a dynamic grip wherein the fingers and palm of the user's hand are not maintained static but are allowed to flex and move a limited, though adequate, amount or distance to maintain circulation and greatly reduce fatigue. In this regard, it is generally well known and recognized that one of the greatest factors for hand fatigue as well as fatigue of one's arm is the maintaining of a static forceful grip. This fatigue factor is experienced by most people and is compensated for by repeatedly releasing and slightly changing one's grip on handles of devices when in use. Such shifting or changing of one's grip on a handles of whether done consciously or unconsciously, is indicative that fatigue has already set in. With my new handle structure, which as indicated above affords a dynamic grip, the frequency and the extent one finds it necessary to change and adjust his/her grip on or about the handle is notably reduced and is evidence that the fatigue factor, noted above, has been reduced substantially.

My new handle structure H next includes a soft yielding compressible finger engaging pad P at and extending longitudinally of the outer side 13 of the handle. The pad is made of foamed synthetic rubber or any one of a number of equivalent common plastic materials and is sufficiently hard or stiff so as not to notably flow, laterally, under applied forces yet sufficiently soft to yieldingly compress in advance of applied finger pressure and to conform to the outer end portions of the user's fingers and thumb that are urged into pressure gripping engagement with it.

In practice, I have found that, in the case of standard hammer structures, the pad P is preferably about one quarter inch thick and preferably is substantially coextensive with the outer side of the handle. In the case of tennis racket handles and the like, wherein the outer finger engaging sides of the handles are substantially flat and present a large surface area, the pad P need not be greater than one eighth of an inch thick.

In practice and as shown, the outer side of the handle H is recessed as at 20 to accommodate the pad P and the outer surface 27 of the pad P is shaped to conform to the shape of a standard handle and to join and fair smoothly with the surfaces of the adjacent front and rear edged portion of the handle. Thus, the pad P is not a large and cumbersome addition or an obstructive protuberance on the handle, but rather is a neat, smooth and attractive part that in no way enlarges or alters the familiar and long accepted basic configuration of a hammer handle.

In practice, the pad P can be cemented in the recessed 20 and, as shown, can be retained in the recess and with the handle by a plurality of elongate, longitudinally extending flanges F formed integrally on the pad and yieldingly forcibly entered into the through openings O of the handle, in retained engagement therein. The flanges F also serve to yieldingly transmit forces between and support the webs. Additionally, they dampen vibratory and/or harmonic movement of the leaf spring like webs W of the handle. This desirable function has been observed when the handle is first used without the flanges engaged between the webs and is thereafter used with the flanges in place. Without the flanges F in place, readily detectable harmonic vibrations and sounds are not infrequently generated in and through the handle. With the flanges in place, such vibrations and sounds are eliminated, yet the flexibility and/or compressibility of the handle, within the grip of the user, is not notably effected.

The handle H can have a pad similar to the pad P at its inner side, but is preferrably provided with a plurality of longitudinally extending, laterally spaced parallel ribs R of the same yielding compressible material of which the pad P is made. The ribs R project out from the surface 30 of the inner side 12 of the handle and serve as soft, yielding, conformible cleats which engage the fleshy palm of the user's hand and prevent undesired rotational movement or displacement of the handle within the user's grip. Such turning of a handle in a user's grip, if let to occur, results in or tends to cause turning of the handle beneath the user's fingers, adding an additional and readily perceived secondary force which the user must counter and which can only accelerate fatigue.

The ribs R, in addition to serving as cleats, as above noted, also provide a soft, comfortable, yielding support for the palm of the user's hand and cooperate with the exterior surface of the handle to create air circulating channels through which air can move to keep the portion of the user's hand opposing the inner side of the handle cool and dry and/or through which fluids trapped between the user's palm and the handle can flow and escape.

In the preferred carrying out of my invention and as shown, the ribs R are established by laterally inwardly projecting longitudinal extensions of the flanges F on the pad P.

In practice, if the number and size of ribs can be effectively increased from three, as shown, to six or eight.

In one effective embodyment of my invention, the pad P at the outer side of the handle was replaced with such ribs to attain satisfactory results. For example, in the case of a tennis racket handle, six ribs R' project from and extend longitudinally of both the inner and outer sides of the handle H', as shown in FIGS. 5 and 6 of the drawing.

It is to be noted that the ribs R project from their adjacent side portions of the handle and are such that the handle need not be recessed to accomodate them. Thus, the basic handle structure is not unduly weakened or made more costly and difficult to make by requiring that both of the inner and outer sides of the handle be recessed.

It is to be further noted that the pad P, flanges F and ribs R can, as shown, be formed integrally as a single molded part and simply pressed into engagement with the slotted handle structure, thus making mass production and assembly of the handle easy and economical.

If the handle H is made of wood, the slots or through openings O must be cut therethrough as by means of a gang of rotary saw blades. If, on the other hand, the handle is made of molded or cast material, the slots are easily established during molding or casting of the handle. In those cases where the handle is established of cast or molded materials a considerable quantity of material is eliminated by the slots and the resulting handle structure is made considerably lighter. It has been determined that such savings of such material and reduction of weight would result in an economic savings which would soon pay for the production and assembly of the molded unitary pad, flange and rib part, if the handle was mass produced. Thus, the handle that I provide, if mass produced, would be no more costly than a conventional fiberglass handle or the like.

Having illustrated and described typical preferred forms and embodiments of my invention, I do not wish to be limited to the specific details herein set forth but wish to reserve to myself any modifications and/or variations that might appear to those skilled in the art and which fall within the scope of the following claims.

Having describe my invention, I claim:

1. An improved handle structure for manually manipulated devices comprising an elongate vertically extending handle of flexible elastic material, the handle has upper and lower ends, a central longitudinal axis, a central vertical plane with opposite inner and outer sides and intersecting with said axis, oppositely disposed elongate front and rear edge portions extending parallel with the central axis and on planes normal to said central plane, oppositely disposed elongate inner and outer sides spaced laterally outward from the inner and outer sides of and substantially parallel with said central vertical plane, a plurality of longitudinally extending through slot openings with upper and lower ends spaced below and above said upper and lower ends of the handle, said slot openings are in spaced relationship between the front and rear edge portions on planes normal to said central vertical plane, said slot openings open at said inner and outer sides of the handle and define a plurality of elongate thin, flat, longitudinally extending parallel webs with upper and lower ends, said webs are substantially rectangular in cross section with their major cross sectional axes normal to and with their minor cross sectional axes parallel with said central vertical plane, said webs are strong and substantially non-yielding in advance of forces directed laterally onto and through the handle and are yieldingly flexible in advance of forces directed forwardly and rearwardly onto and through the handle between the upper and lower ends thereof, a flat finger-supporting pad of resilient yieldingly compressible synthetic, rubber-like material secured to and substantially co-extensive with said outer side of the handle, and elongate resilient yieldingly compressible flanges of synthetic, rubber-like material in said slot openings between said webs and yieldingly transmitting forces between said webs and dampening vibratory movement thereof, said flanges.

2. The improved handle structure set forth in claim 1 wherein said flanges have longitudinally extending laterally inwardly projecting edge portions projecting from said slot openings and the inner side of the handle and defining hand engaging cleat-like beads.

3. The improved handle structure set forth in claim 1 wherein said flanges have longitudinally extending laterally inwardly projecting edge portions projecting from said slot openings and the inner side of the handle and defining hand engaging cleat-like beads, said beads cooperate with said inner side of the handle and define longitudinally extending air conducting channels on said inner side of the handle.

4. An improved handle structure for manually manipulated devices comprising an elongate vertically extending handle of flexible elastic material, the handle has upper and lower ends, a central longitudinal axis, a central vertical plane with opposite inner and outer sides and intersecting with said axis, oppositely disposed elongate front and rear edge portions extending parallel with the central axis and on planes normal to said central plane, oppositely disposed elongate inner and outer sides spaced laterally outward from the inner and outer sides of and substantially parallel with said central vertical plane, a plurality of longitudinally extending through slot openings with upper and lower ends spaced below and above said upper and lower ends of the handle, said slot openings are in spaced relationship between the front and rear edge portions on planes normal to said central vertical plane, said slot openings open at said inner and outer sides of the handle and define a plurality of elongate thin, flat, longitudinally extending parallel webs with upper and lower ends, said webs are substantially rectangular in cross section with their major cross sectional axes normal to and with their minor cross sectional axes parallel with said central vertical plane, said webs are strong and substantially non-yielding in advance of forces directed laterally onto and through the handle and are yieldingly flexible in advance of forces directed forwardly and rearwardly onto and through the handle between the upper and lower ends thereof, elongate resilient yieldingly compressible flanges of synthetic, rubber-like material within said slot openings and between said webs, said flanges yieldingly transmit forces between said webs and dampen vibratory movement thereof, said flanges have longitudinally extending laterally inwardly and laterally outwardly projecting edge portions projecting from said slot openings and from said inner and outer sides of the handle and defining hand engageable, cleat-like beads on said sides of the handle.

5. The improved handle structure set forth in claim 4 wherein said beads cooperate with their related inner and outer sides of the handle and define longitudinally-extending air-conducting channels on said sides of the handle.

* * * * *